US008333350B2

(12) United States Patent
Sando

(10) Patent No.: US 8,333,350 B2
(45) Date of Patent: Dec. 18, 2012

(54) DOUBLE IMPEDANCE BOND

(75) Inventor: Dennis Sando, Lino Lakes, MN (US)

(73) Assignee: Mag-Con Engineering, Lino Lakes, MN (US)

( * ) Notice: Subject to any disclaimer, the term of this patent is extended or adjusted under 35 U.S.C. 154(b) by 355 days.

(21) Appl. No.: 12/648,112

(22) Filed: Dec. 28, 2009

(65) Prior Publication Data

US 2010/0163686 A1 Jul. 1, 2010

Related U.S. Application Data

(60) Provisional application No. 61/140,919, filed on Dec. 26, 2008, provisional application No. 61/145,911, filed on Jan. 20, 2009.

(51) Int. Cl.
*B61L 21/00* (2006.01)

(52) U.S. Cl. ..... 246/37; 333/24 R; 246/34 R

(58) Field of Classification Search ..... 246/37
See application file for complete search history.

(56) References Cited

U.S. PATENT DOCUMENTS 1,304,294 A * 5/1919 Fortescue ..... 246/37
3,927,851 A * 12/1975 Wilcox ..... 246/37
4,389,033 A * 6/1983 Hardman ..... 246/37
4,509,024 A * 4/1985 Wilson ..... 333/24 R
4,622,522 A * 11/1986 Alt ..... 333/24 R
2007/0138927 A1* 6/2007 Weger ..... 313/231.01
2009/0079402 A1* 3/2009 Nakahori ..... 323/255
2010/0163686 A1* 7/2010 Sando ..... 246/37
2010/0321960 A1* 12/2010 Nakahori ..... 363/21.04

FOREIGN PATENT DOCUMENTS

WO WO 91/07766 5/1991

OTHER PUBLICATIONS

Union Switch & Signal Service Manual 6465, "Impedance Bond Adapter Kit" Feb. 1992, pp. 1-55.
Twinco Mfg. Co., Inc., Impedance Bond, pp. 1-4.

* cited by examiner

*Primary Examiner* — Jason C Smith
(74) *Attorney, Agent, or Firm* — Patterson Thuente Christensen Pedersen, P.A.

(57) ABSTRACT

A low profile double impedance bond for placement between a pair of rails and for electrical connection to opposite sides of a pair of insulated breaks on the pair of rails, the impedance bond comprising a rectangular enclosure attachable to ties supporting the pair of rails, the enclosure having a pair of ends and a pair of sides, each side for alignment parallel to one of the rails, the impedance bond having four coils each formed of a strip of copper foil with two ends wound in a spiral configuration about a core, the impedance bond having a terminal connection array formed of a plurality of copper conductors, the conductors, cores, and coils are arranged in a low profile manner on a single platform allowing quick installation inbetween rails.

15 Claims, 6 Drawing Sheets

DOUBLE IMPEDANCE BOND

This application claims the benefit of the following applications: U.S. Provisional Patent Application No. 61/140,919, filed Dec. 26, 2008, entitled DOUBLE IMPEDANCE BOND, and U.S. Provisional Patent Application No. 61/145,911, filed Jan. 20, 2009, of the same title, the disclosures of which are hereby incorporated by reference in their entirety.

FIELD OF THE INVENTION

This invention relates to the field of railways. More particularly, the invention relates to impedance bonds used to provide an electric connection between insulated rails.

BACKGROUND OF THE INVENTION

Track circuits are used in railway systems to detect the presence or absence of a train on rail tracks. Generally, track circuits work by applying power to each rail and a relay coil across the rails. The track itself is separated into defined sections, separated by insulating joints. In order to prevent one circuit from accidentally powering another in the event of insulation failure, the polarity of each section alternates from section to section. When no train is present on the rails, the relay is energized by a track signal current flowing from the power source to the rails. When a train is present on the rails, the axles and wheels of the train shunt the track, so the track signal current to the relay is shorted as well.

Because direct current (DC) track circuits can cause large traction return currents on the rails that overwhelm much smaller track signal currents, alternating current (AC) track circuits are often utilized, which use an AC frequencies in the range of about 91 Hz to 250 Hz. The relays are then designed to detect a specific frequency and to disregard all other AC and DC traction frequency signals. When the traction return current passes through only one rail, the configuration is known as an AC single rail track circuit.

AC double rail track circuits are those in which the traction return current passes through both rails of the track circuit. Electrified railways with AC double rail track circuits utilize impedance bonds as a means for providing an electric connection items that need to be connected for electrification but must stay isolated from track frequencies in order for the track circuit to function. The impedance bond provides a connection between the isolated rails, permitting the traction return current to continue to travel from one section of insulated rail to the next section, while blocking the track signal current from passing outside its relay coil.

Prior art impedance bonds often include a single bond self-contained within a heavy duty cast iron or steel housing, often referred to as a tub, which, with difficulty, could be mounted between the rails, such as the one disclosed in U.S. Pat. No. 4,509,024 to Wilson. Two such bonds are required at each insulating joint. Enclosed within the housing is a core, formed of a band of silicon steel and formed into a U-shape. On each of the two legs of the core are identical copper coils of equal resistance, wound on an identical mandrel to result in identical electrical characteristics. Attached to the end of each coil is a terminal strap that extends outward from the housing.

The U-shaped cores are commonly known in the art as C-cores. The use of C-cores is generally well-known. Wound from silicon steel strips, C-cores are especially suited in transformers where the primary and secondary windings are physically separated.

Prior art impedance bonds made by Power Engineering Industries have a low profile and are designed for installation above tie level and between rails. These units allow for AC and DC propulsion configuration, 300 Amp/Rail AC to 3000 Amp/Rail DC models, and fixed impedance or custom-tunable designs, and are designed to Association of American Railroads (AAR) standards.

Oftentimes, however, despite efforts to balance the two coils in the impedance bond, imbalances still occur on the core. Additionally, high currents often result in overheating of the impedance bonds. The prior art also generally requires several hours in order to install, resulting in delays in scheduled trains that utilize the railway tracks. Another concern is the desire to create low profile units that can be installed between railway line sleepers without protruding into track bed material. C-core impedance bonds generally do not lend themselves to a low profile bond. Furthermore, impedance bonds must be operationally immune from the effects of false signaling that often occurs as a result of high transient currents.

Moreover, terminal straps connecting to the coils in conventional impedance bonds are less robust that ideal and often have numerous bends and excessive vertical profiles that are inconsistent with a low profile impedance bond.

Consequently, there exists a need in the industry for an impedance bond that overcomes the drawbacks of the prior art.

SUMMARY OF THE INVENTION

Embodiments of the present invention address the need of the industry and overcome the drawbacks of prior art impedance bonds. These embodiments are designed to meet the Association of American Railroads (AAR) standards. According to embodiments, two impedance bonds are used on a single plate, simplifying installation.

The low profile double impedance bond is, in the plan view, displaying a single rectangular housing for placement between a pair of rails of a railroad track with a greater dimension of the rectangular shape aligned with the rails. The low profile double impedance bond comprises two coil assemblies, a first coil assembly and a second coil assembly, each having a stacked UI core, a first core and a second core, the core assemblies aligned in a direction parallel to the rails when positioned in their intended placement between the train track rails. Each UI coil assembly has two legs with a coil on each leg, the legs aligned with the rails and thus the axis of the cores aligned with the rails. The coils are thus arranged generally defining the four corners of a rectangle. Each respective coil assembly has a first coil and a second coil with four ends, two of the ends of the two coils connected defining a centertap and the two other ends for electrical connection to the rails. The coils are formed from strips of copper foil.

In an embodiment, terminal straps connect to the ends of the coils of the impedance bond. The straps have a greatest dimension as a length, which extends exclusively in the horizontal place, a second greatest dimension as a height, which is extends exclusively in vertical direction, and a lesser dimension as a thickness, which extends in the horizontal plane. The rail connection terminal straps that connect, by way of cables to the rails on opposite sides of the insulated joints extend in a single horizontal plane, that is, there are no vertically extending strap sections. Moreover, these four terminal straps that electrically connect to the rails lie adjacent to the core sections, intermediate the core sections and windings and are single straight pieces with no bends and are installed with the terminal straps parallel to the rails. This greatly simplifies manufacture and reduces the height and thickness of the impedance bonds. Four terminal straps also define and connect at the centertaps of the two respective coil assemblies. The four terminal straps each having an "L" shape with all four connecting to a single elongate terminal transverse strap extending perpendicular to the direction of the rails when installed. These four terminal straps are each positioned on the exterior portion of the coil and thus do not have the structural support by being sandwiched between the core and windings to provide an optimal stability and structural support that the rail connection terminal straps have. The four L shaped terminal straps rely on a common connection to a single elongate strap member providing structural support to the assembly. External connection to the center taps then may be made on either of the two ends of the transverse strap. In some installations, this is grounded. Thus, any stresses on the ends of the transverse strap, such as during a connection process, are effectively shared approximately equally amongst the four L shaped terminal straps connecting to the outer coil assemblies.

According to embodiments, UI lamination is used instead of the conventional cut C-core. UI lamination allows for the use of two coils rather than a single coil. Additionally, where C-core does not lend itself to a low profile bond, embodiments of the present invention allow for low profile bonds.

According to embodiments, unlike EI lamination, UI laminations are inherently symmetrical and reduce the occurrence of imbalanced currents. The performance of signaling in track circuits is greatly affected by imbalanced currents. The present invention significantly improves the performance of signaling in track circuits and reduces the sensitivity of the track.

In an embodiment, the coils and core assembly is mounted on a plate and covered with an enclosure portion to form a box. The enclosure portion having two end walls, two side walls, and top. A pair of slots on each end wall provide clearance for the rail attachment terminal straps to extend to exterior the enclosure portion and the box. A slot on each side wall provides clearance for the centertap terminal strap connections to extend therethrough.

In an embodiment of the invention, the coils, cores, and terminal straps are arranged and mounted to a single plate and configured to provide a low profile, not any higher than the tracks within which the device will be attached. The cores and the conductor array are all coplanar and positioned in a horizontal plane, the y-z plane.

The above summary of the various representative embodiments of the invention is not intended to describe each illustrated embodiment or every implementation of the invention. Rather, the embodiments are chosen and described so that others skilled in the art may appreciate and understand the principles and practices of the invention. The figures in the detailed description that follows more particularly exemplify these embodiments.

BRIEF DESCRIPTION OF FIGURES

These as well as other objects and advantages of this invention, will be more completely understood and appreciated by referring to the following more detailed description of the presently preferred exemplary embodiments of the invention in conjunction with the accompanying drawings of which.

Figure 1:
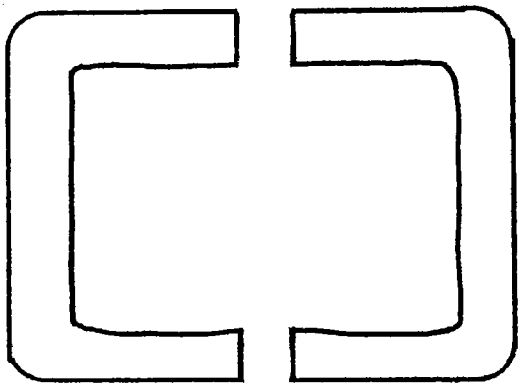
Fig. 1 (prior art)
FIG. 1 shows the cut C-cores of the prior art.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION

In the following detailed description of the present invention, numerous specific details are set forth in order to provide a thorough understanding of the present invention. However, one skilled in the art will recognize that the present invention may be practiced without these specific details. In other instances, well-known methods, procedures, and components have not been described in detail so as not to unnecessarily obscure aspects of the present invention.

The present invention is directed to impedance bonds used to provide an electric connection between insulated rails. Because two bonds are used on a single plate, these bonds are described herein as double impedance bonds.

Impedance bonds provide a connection between the electrically isolated rails on train tracks, permitting the traction return current to continue to travel from one section of insulated rail to the next section, while blocking the track signal current from passing outside its relay coil.

Prior art impedance bonds are often self-contained within a heavy duty cast iron or steel housing, which may be mounted between the rails, such as the one disclosed in U.S. Pat. No. 4,509,024 to Wilson. Enclosed within the housing is a core, formed of a band of silicon steel and formed into a U-shape. On each of the two legs of the core are identical copper coils of equal resistance, wound on an identical mandrel to result in identical electrical characteristics. Attached to the end of each coil is a terminal strap that extends outward from the housing.

The U-shaped cores are commonly known in the art as C-cores, as shown in FIG. 1. The use of C-cores is generally well-known. C-cores are typically made by winding silicon steel strips around a rectangular form and bonding the separate layers together. The winding is then cut into two separate pieces, which form two C shapes. The core is formed by bind two "C"s together with a steel shape. C-cores are especially suited in transformers where the primary and secondary windings are physically separated.

Figure 2:
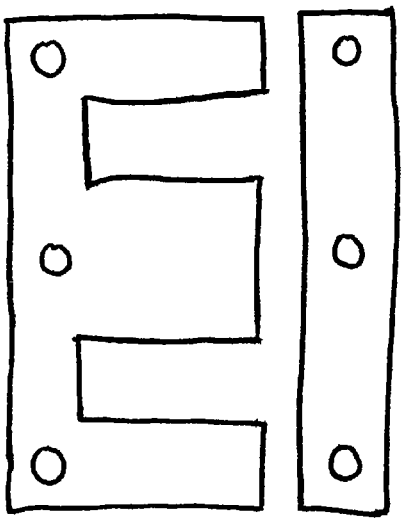
Fig. 2 (prior art)
FIG. 2 shows the EI lamination of the prior art.

Other impedance bonds of the prior art utilize cores with an EI configuration, as shown in FIG. 2. In an EI-core transformer, formed of laminations such as the one shown in FIG. 2, the windings are wound around the center "leg" of the "E"; the "I" is joined next to the "E" to form a closed magnetic path. These laminations are die cut from a continuous roll of thin-gauge magnetic material into the specific shape "E" and "I" shapes. Most commonly, low grade non-oriented or high-grade oriented types of silicon-iron are used. Nickel-iron or cobalt-iron thin-gauge materials are also used for these laminations. In order to be stacked, these laminations must be precisely stacked in order to form the core. EI-cores are often the least expensive, but they are prone to suffer from stray flux as a result of air gaps between lamination layers.

Figure 3:
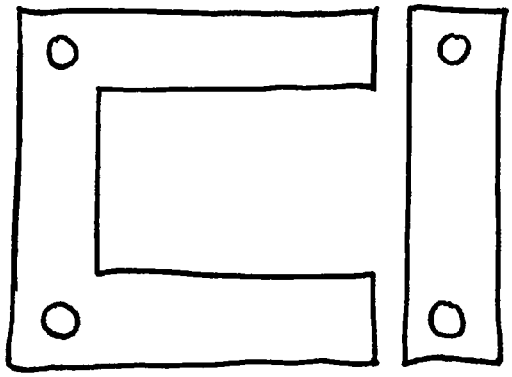
FIG. 3 is the UI lamination of the present invention.
Figure 9:
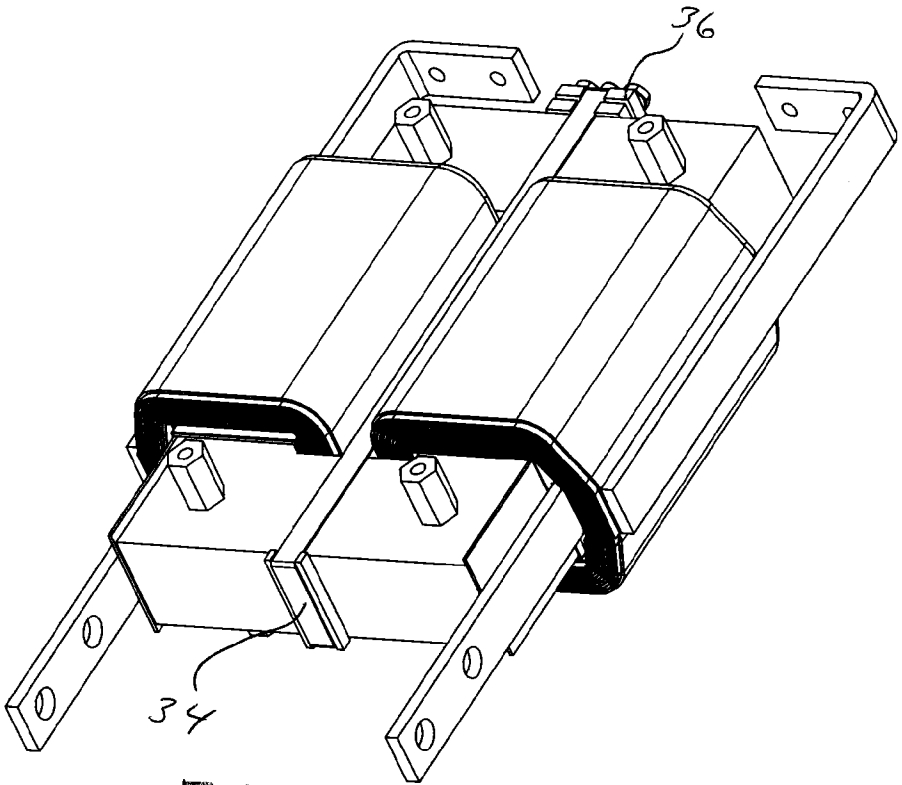
FIG. 9 shows a perspective view of the opposite end of the coil assembly shown in FIG. 8.
Figure 8:
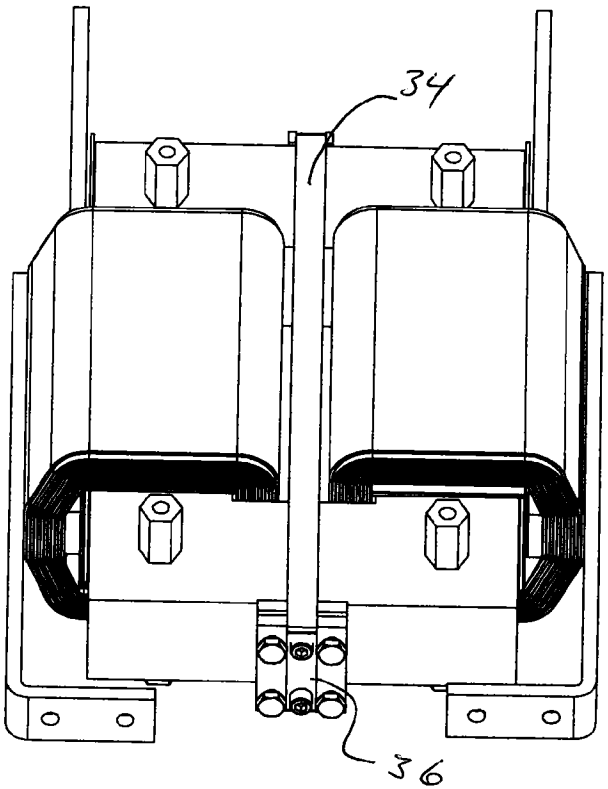
FIG. 8 shows a perspective end view of a coil assembly of a double impedance bond of the present invention.

Alternatively, UI laminations, as shown in FIGS. 3, 8, and 9, may be used to form cores. Like EI-cores, UI-cores are formed from stacked laminations made from materials such as silicon-iron, nickel-iron, or cobalt-iron. Unlike the C-core, also used in the prior art, which does not lend itself to a low profile bond, UI laminations allow for lower profile impedance bonds, which is ideal for mounting above the tie level and between the train rails. In addition to the low profile benefits of the UI lamination-made cores, UI laminations are often less expensive than other lamination alternatives.

In impedance bonds of the prior art, only a single bond in a single housing is used. In addition to the drawbacks associated with higher profile bonds, installing two of these single impedance bonds can take hours to install between rails. With the average time between trains on many Amtrak schedules being only about thirty minutes, requiring several hours to install an impedance bond can cause undesirable delays. The double impedance bonds of the present invention contain two bonds on a single plate, as shown in FIGS. 4, 5, 6 and 7, allowing for installation times reduced to only about fifteen minutes.

Figure 6:
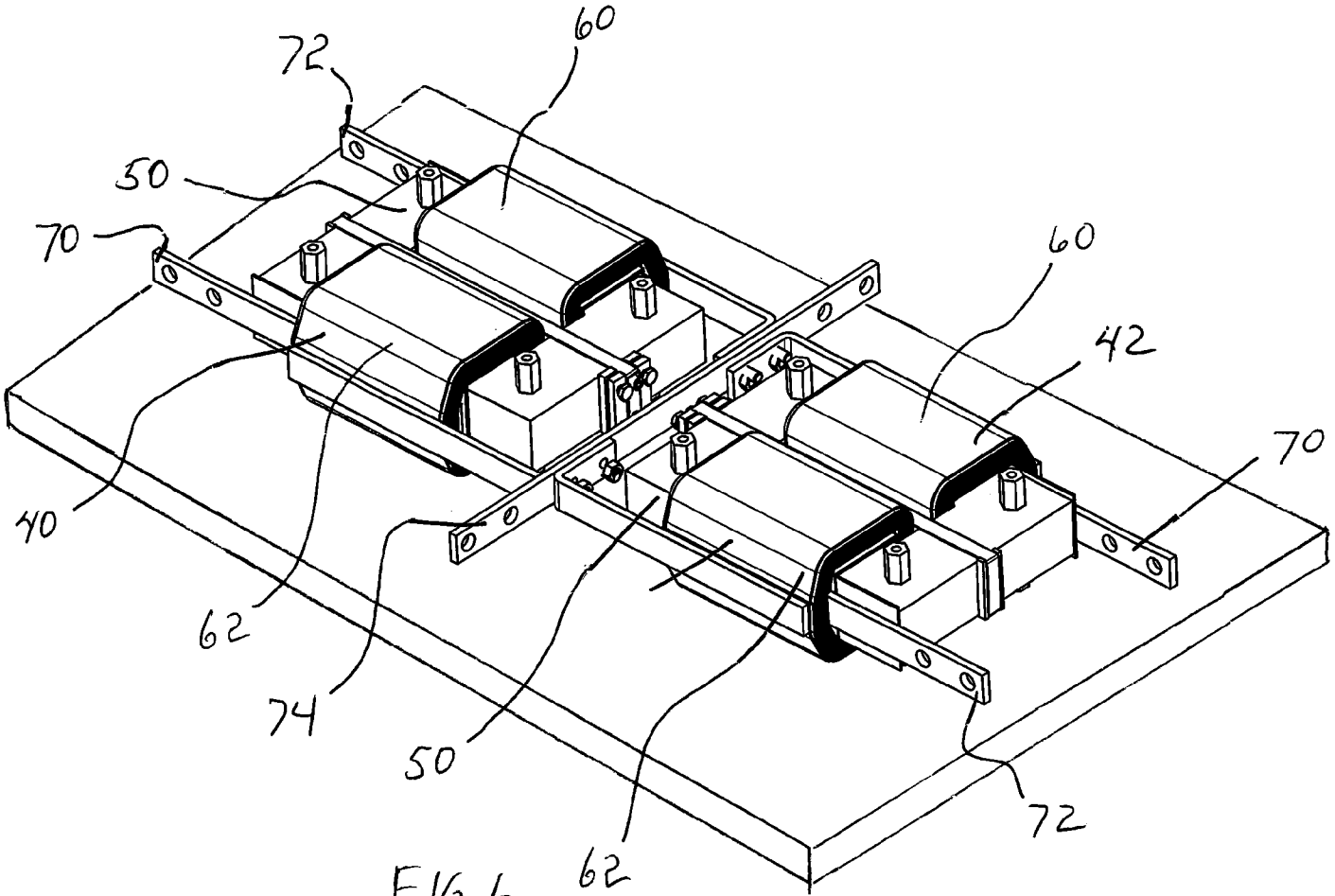
FIG. 6 shows a perspective view of a double impedance bond of the present invention with the enclosure portion removed.

In an embodiment of the invention, the first and second coils are wound on opposite sides of the core, as shown in FIG. 6. This provides an inherently symmetrical configuration, which reduces the occurrence of imbalanced currents. Furthermore, this structure of the windings helps to cancel out stray magnetic fields. The performance of signaling in track circuits is greatly affected by imbalanced currents. Additionally, these UI-core transformers often radiate less magnetic interference than their EI-core transformer counterparts. In one embodiment of the invention, the double impedance bonds are designed to operate between 300 Amps/rail to 1,000 Amps/rail.

To reduce the possibility of the core saturating with magnetic flux in the case of a very large track current imbalance or other causes, a small air-gap is created at the junction of the "U" and "I" sections of the core. To properly adjust the characteristics of the bond assembly, it is necessary to maintain that air-gap to close tolerances. An insulating material, usually a fibrous mat of known thickness, or other paper-like material, is inserted between the "U" and "I" sections of the core. This material is generally inserted between the end of both "U" section legs, although is some embodiments, it may be inserted at the end of only one leg.

To maintain the air-gap tolerance, some method of applying uniform tension across the gap is necessary. In "C" core embodiments, the general method is to wrap a steel band around the core, under the coils, apply a measured tension, and then secure the steel band with a formed clip. The tension achievable with this method is variable, and may require several attempts to correctly tension the band. In this embodiment, a fixed band 34 with an adjustable tensioning device 36 is employed. This device applies equal and uniform pressure across the entire air-gap and is easily adjusted without special tools. Once the proper tension is achieved, the tensioning device is locked. This method is repeatable, and allows close matching of the characteristics of the bond pair.

Figure 5:
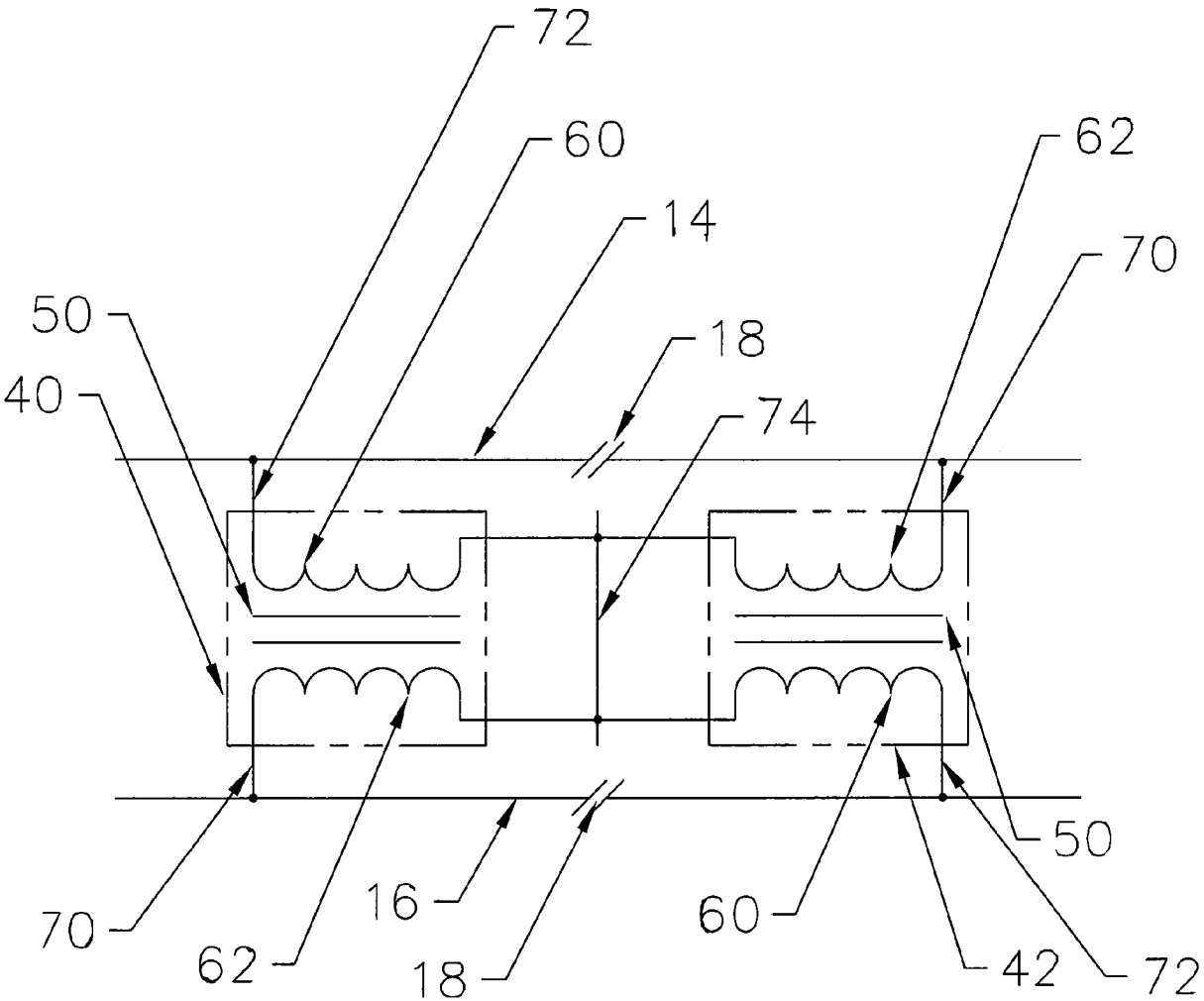
FIG. 5 is a schematic view of the impedance impedance bond of the present invention.

FIGS. 6, 7, 8 and 9 illustrate pertinent components of the low profile double bond 10. FIG. 5 is a schematic and FIG. 7 a perspective view of the apparatus connected between rails 14, 16 with insulated joints 18. The apparatus comprises first and second coil assemblies 40, 42 each have a core 50 with two legs and a first coil 60 and a second coil 62 on the cores. Rail connection terminal straps 70, 72 extend out from each end of the apparatus for connection by cables 63 to the rails on opposite sides of the insulated joints. These rail connection terminal straps are positioned intermediate the coil and core and have no bends. The centertap connection 74 is formed by four L-shaped terminal straps each connected to an end of one of the coils. A transverse terminal strap has each of the L-shaped straps bolted thereto.

The coils are, in one embodiment, wound of copper foil 5.687" wide by 0.050" thick and 12 turns per coil.

Figure 4:
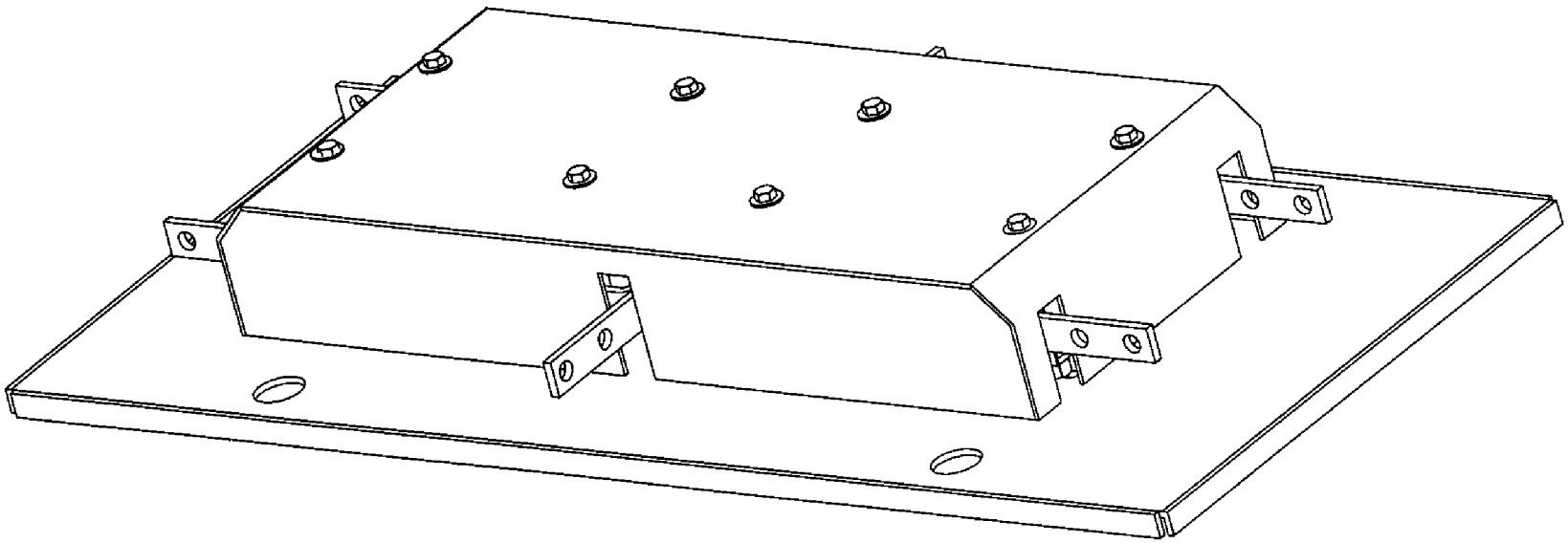
FIG. 4 is a perspective view of a double impedance bond of the present invention. The view from the opposite corner being a mirror image thereof.
Figure 7:
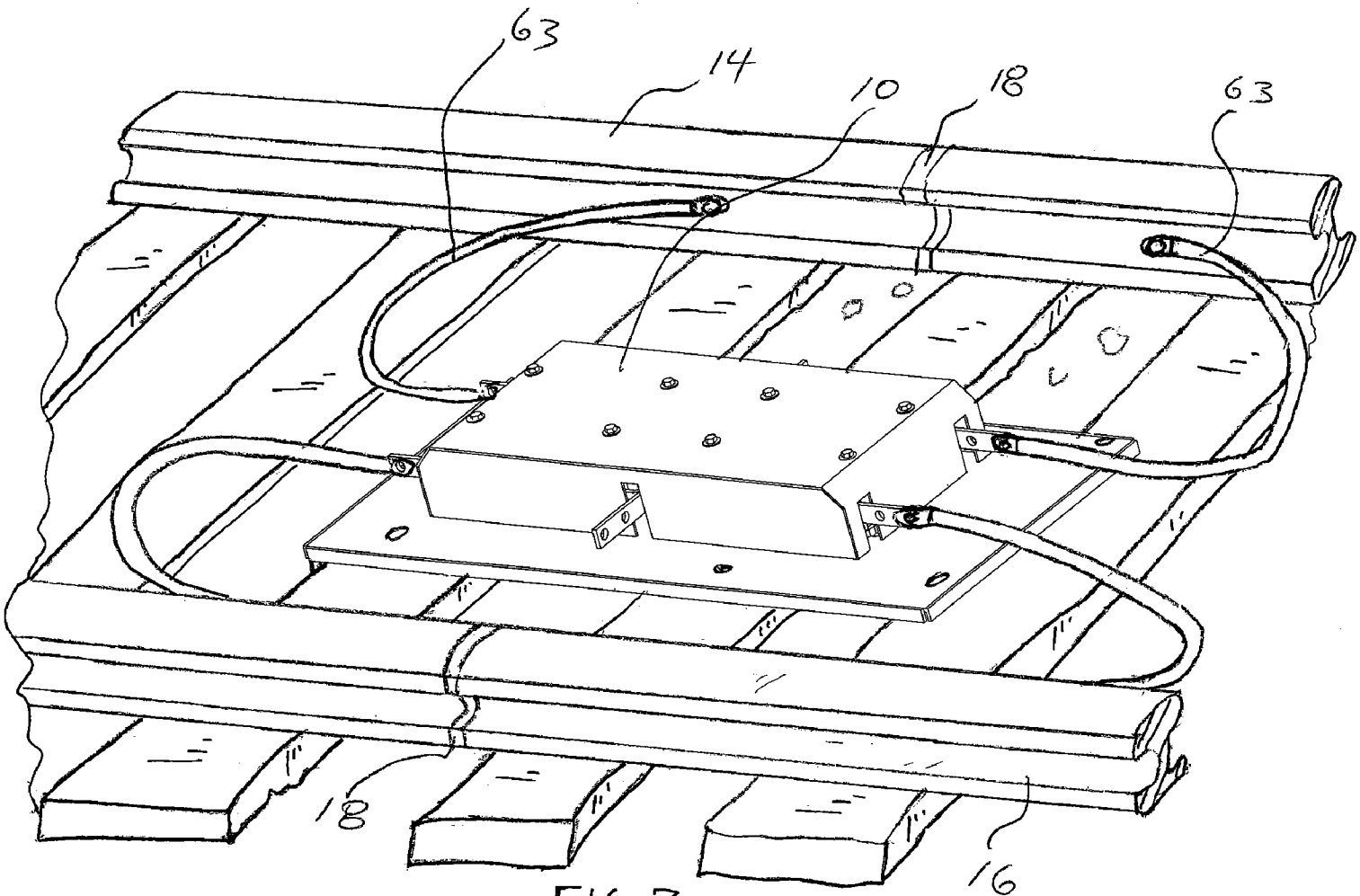
FIG. 7 shows a perspective view of a double impedance bond of the present invention in place between railroad rails.

After the entire coil/core structure is assembled, two such coil/core structures are attached to a common plate 80 to create the double impedance bond. The double impedance bond is then covered in a protective housing, as shown in FIGS. 4 and 7. The protective housing may be made of heavy duty cast iron. Those having skill in the art will appreciate that other similar protective materials, such as steel, may be used to make the protective housing. In one embodiment of the invention, the protective housing is removable. In one embodiment, the protective housing protects the double impedance bond from flying debris or anything that may be hanging from under the carriage of a passing train.

Before being covered by a protective housing, the entire coil/core assemblies is sealed in a protective covering. In one embodiment of the invention, a protective varnish may be used. In another embodiment, a protective epoxy varnish may be used.

In one embodiment of the invention, in use, the double impedance bond is installed between insulated joints along the rail. The double impedance bond permits the traction return current to continue to travel from one section of insulated rail to the next section, while the inductive impedance of the bond coils blocks the track signal current from passing outside its relay coil.

It will be appreciated by those of ordinary skill in reading this disclosure that numerous variations of the invention may be contemplated and are within the scope of the present invention. For example, while silicon-iron is commonly used to make UI laminations, other materials such as nickel-iron and cobalt-iron may be used as well. It also be appreciated that the present invention is not limited to particular geometries or physical structures. Additionally, although two impedance bonds on a plate are depicted herein, any number of impedance bonds may be installed on a plate.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

What is claimed is:

1. A low profile double impedance bond for connection to opposite sides of a pair of insulated breaks on a pair of rails, the impedance bond comprising a rectangular enclosure configured for placement intermediate the pair of rails and attachable to ties supporting the rails, the enclosure including a bottom plate portion, the impedance bond further comprising a first coil assembly and a second coil assembly, each of the coil assemblies mounted to the bottom plate portion, each of the coil assemblies having a stacked UI core with a first coil and a second coil wound around the stacked UI core, each coil having a winding of copper sheet material with two ends and a pair of terminals straps soldered to the ends of the copper sheet material, each of the terminal straps having a rectangular cross-section and having a solder portion and a terminal connection portion, one of the terminal straps configured as a rail connection terminal strap and extending out of the end of the enclosure and the other configured as a centertap connection terminal strap and extending in an inboard direction for electrical connection with the other centertap connection terminal straps, the rail connection terminal strap extending out of the enclosure having its solder portion positioned proximate the core and having the winding of the copper sheet material extending over said terminal strap thereby providing structural support.

2. The low profile double impedance bond of claim 1 wherein each of the coils has an L shaped centertap connection terminal strap and said L shaped centertap connection terminal straps are electrically connected together at a terminal strap that extends out both sides of the enclosure.

3. The low profile double impedance bond of claim 1, wherein each of the rail connection terminal straps is linear without any bends therein.

4. The low profile double impedance bond of claim 1, wherein all of the terminal straps are arranged substantially coplanarly.

5. The low profile double impedance bond of claim 1, wherein the rail connection straps are structurally supported exclusively by being positioned intermediate a coil and core.

6. The low profile double impedance bond of claim 1, wherein each of the centertap terminal straps are connected to a linear terminal strap extending out both sides of the enclosure.

7. The low profile double impedance bond of claim 1, wherein the height of the enclosure when placed on the ties inbetween a pair of rails does not exceed the height of the rails.

8. A low profile double impedance bond for placement between a pair of rails and for electrical connection to opposite sides of a pair of insulated breaks on the pair of rails, the impedance bond comprising a rectangular enclosure attachable to ties supporting the pair of rails, the enclosure having a pair of ends and a pair of sides, each side for alignment parallel to one of the rails, the impedance bond having four coils each formed of a strip of copper foil with two ends wound in a spiral configuration about a core, the impedance bond having a terminal connection array formed of a plurality of copper conductors, each having a rectangular cross section, the plurality of copper conductors all in a coplanar alignment, wherein each of the four coils has an inboard extending centertap connection terminal strap connected a junction terminal strap that extends out both sides of the enclosure.

9. A low profile double impedance bond of claim 8, wherein each of the centertap terminal straps are connected to a linear terminal strap extending out both sides of the enclosure.

10. A low profile double impedance bond for placement between a pair of rails and for electrical connection to opposite sides of a pair of insulated breaks on the pair of rails, the impedance bond comprising a rectangular enclosure attachable to ties supporting the pair of rails, the enclosure having a pair of ends and a pair of sides, each side for alignment parallel to one of the rails, the impedance bond having two coil assemblies, each coil assembly formed of two coils disposed on a single core, each coil formed of a strip of copper foil with two ends and wound in a spiral configuration about the core, the core formed of a plurality of layers, each layer having a C shaped piece of sheet metal and an I shaped piece of sheet metal to form a UI configuration layer, a plurality of the UI configuration layer stacked on one another.

11. The low profile double impedance bond of claim 10 wherein each of the four coils has an inboard extending centertap connection terminal strap connected to a junction terminal strap that extends out both sides of the enclosure.

12. A low profile double impedance bond of claim 10, wherein each of the four coils has a rail connection terminal strap extending therefrom and wherein each of said rail connection terminal strap is linear and extends in an outboard direction from said coils.

13. A low profile double impedance bond of claim 10, wherein all of the terminal straps have a rectangular cross section and wherein the greater dimension of the rectangular cross section is vertical for all of the terminal straps.

14. The low profile double impedance bond of claim 12, wherein cores have a length, a width, and a thickness, and wherein the length and the width are greater than the width, and the coils and the terminal straps are arranged to be in coplanar alignment.

15. The low profile double impedance bond of claim 10, further comprising an enclosure and wherein the height of the enclosure when placed on the ties inbetween a pair of rails does not exceed the height of the rails.

* * * * *